US008707912B2

(12) United States Patent
Kim

(10) Patent No.: US 8,707,912 B2
(45) Date of Patent: Apr. 29, 2014

(54) FURNACE OF BOILER FOR POWER STATION

(76) Inventor: Byung-Doo Kim, Seoul (KR)

( * ) Notice: Subject to any disclaimer, the term of this patent is extended or adjusted under 35 U.S.C. 154(b) by 1211 days.

(21) Appl. No.: 12/565,569

(22) Filed: Sep. 23, 2009

(65) Prior Publication Data

US 2010/0071634 A1 Mar. 25, 2010

(30) Foreign Application Priority Data

Sep. 23, 2008 (KR) ..... 10-2008-0093199
Sep. 23, 2008 (KR) ..... 10-2008-0093201
Sep. 3, 2009 (KR) ..... 10-2009-0083113

(51) Int. Cl.
*F22B 23/04* (2006.01)

(52) U.S. Cl.
USPC ..... 122/235.14; 122/235.23

(58) Field of Classification Search
USPC ..... 122/235.14, 235.23, 235.28, 460, 6 A, 122/11, 12
See application file for complete search history.

(56) References Cited

U.S. PATENT DOCUMENTS

| | | | | |
|---|---|---|---|---|
| 2,567,696 | A * | 9/1951 | Kessler | 122/240.3 |
| 2,793,626 | A * | 5/1957 | Hubel | 122/235.28 |
| 2,982,265 | A * | 5/1961 | Wedertz | 122/235.28 |
| 4,014,296 | A * | 3/1977 | Astrom | 122/235.28 |
| 4,707,991 | A * | 11/1987 | Firey | 60/670 |
| 6,116,196 | A * | 9/2000 | Watanabe et al. | 122/235.11 |
| 6,318,305 | B1 * | 11/2001 | Takubo et al. | 122/235.11 |
| 8,281,750 | B2 * | 10/2012 | Kim | 122/6 A |
| 2007/0186828 | A1 * | 8/2007 | Kim | 110/184 |

* cited by examiner

*Primary Examiner* — Kang Hu
*Assistant Examiner* — John Bargero
(74) *Attorney, Agent, or Firm* — IPLA P.A.; James E. Bame

(57) ABSTRACT

A furnace of a boiler for a power plant includes an outer water tube section adapted to receive water from the outside and heat the water into hot water (including steam); and an inner water tube section adapted to receive water from the outside and heat the water into hot water (including steam) while allowing the water to be moved upwardly. The outer water tube section is formed in a shape gradually increasing or substantially uniform in diameter from the bottom toward the middle portion M, and gradually decreasing, increasing and decreasing again in diameter from the middle portion M toward the top, and the inner water tube section is formed in a shape gradually decreasing and increasing in diameter from the bottom toward the middle portion M, and gradually decreasing, increasing and decreasing again in diameter from the middle portion M toward the top.

5 Claims, 7 Drawing Sheets

FURNACE OF BOILER FOR POWER STATION

CROSS REFERENCES

This application claims foreign priority under Paris Convention to Korean Patent Application No. 10-2008-0093199 filed 23 Sep. 2008, Korean Patent Application No. 10-2008-0093201 filed 23 Sep. 2008, and Korean Patent Application No. 10-2009-0083113 filed 3 Sep. 2009, with the Korean Intellectual Property Office, where the entire contents are incorporated herein by reference.

BACKGROUND OF THE INVENTION

1. Field of the Invention

The present invention relates to a furnace of a boiler for a power plant, in which a combustion space defined between an outer water tube section and an inner water tube section is formed in a shape closest to the natural shape of a flame so that the contact area between the water tube sections and the flame is increased to increasing the temperature of water heated in the water tube sections of the furnace, thereby enhancing the thermal efficiency.

Also, the present invention relates to a furnace of a boiler for a power plant, in which water fed to the furnace is again fed to an inner water tube section via an outer water tube section so that a load of a feed water pump is greatly reduced, thereby increasing the thermal efficiency of the entire system, and an inner water tube wall prevents formation of a fire ball and act as a superheater so as to absorb heat generated from flames in a large amount, thereby preventing the thermal NOx formation caused by a high-temperature fire ball and preventing an ash combustion residue from being molten by the high-temperature fire ball to form slag.

In addition, the present invention relates to a furnace of a boiler for a power plant, in which water fed to the furnace is primarily heated to be separated into hot water and steam in an outer water tube section, and only the separated steam is secondarily heated in an inner water tube section so as to produce a superheated steam more rapidly than in the case where water and steam are heated.

2. Background Art

In general, a boiler widely used in a thermoelectric power plant is largely divided into a coal fired boiler, an oil fired boiler and a gas fired boiler. Among them, the coal fired boiler occupies the majority of the amount of electricity generation, and is roughly classified into a pulverized coal-fired boiler and a fluidized bed boiler.

Since the pulverized coal-fired boiler burns a pulverized (or powdered) coal, it shows a high combustion efficiency but produces nitrogen oxides (NOx) harmful to the atmospheric environment due to high-temperature combustion. Thus, the pulverized coal-fired boiler is adopted in a large-scale power plant which is equipped with a large-sized dust collector capable of treating the nitrogen oxides (NOx). Since the fluidized bed boiler burns coarse coal particles, it is inhibits production of the nitrogen oxides (NOx) due to the low combustion temperature. Thus, in order to improve the heat transfer effect in which the heat of the flame is transferred to water tubes, the fluidized bed boiler heats allows sand granules to be blown upwardly from the bottom of the furnace to heat the sand granules and allows the thus heated sand granules to be moved downwardly along a water tube section disposed at the outside of the furnace, thereby improving the thermal efficiency.

For this reason, in case of the pulverized coal-fired boiler having a high combustion efficiency, the researches are actively in progress to inhibit production of the nitrogen oxides (NOx). Meanwhile, in case of the fluidized bed boiler, attempts are being made to expand the scale of the furnace to improve the thermal efficiency.

In the present invention, an example of the pulverized coal-fired boiler occupying the majority of the coal burning thermal power generation will be described.

A conventional pulverized coal-fired boiler is constructed such that a water tube measuring 7 kilometers in length is arranged in a zigzag pattern in the vertical and horizontal directions so as to maximally absorb the heat from flame erupting upwardly.

Since such a conventional pulverized coal-fired boiler adopts a method in which a plurality of water tubes are densely arranged vertically to increase the heat absorption efficiency from the flame, a load of a feed water pump is abnormally increased which circulates water while forcibly reversing the natural flow direction of the steam so that the water flows an elongated small-diameter water tube having a large flow resistance.

A motor driving this feed water pump consumes 30-40% of the power plant internal consumption. Also, the conventional pulverized coal-fired boiler entails a disadvantage in that it exhausts the nitrogen oxides (NOx) in a large amount, melts the ash to form sticky slag to thereby produce a large amount of clinker, and fouls the filter, which makes impossible to use an inexpensive low-rank coal.

In order to solve such a problem, as shown in FIG. 1, there is proposed a construction of a furnace of a pulverized coal-fired boiler of Korean Registration Patent No. 10-0764903, in which an inner water tube wall 8 consisting of a plurality of water tubes is installed vertically at the center of an outer water tube wall 6 disposed vertically adjacent to the inner circumference of the furnace so that the fuel injected from fuel injection nozzles mounted on the outer water tube wall 6 is burnt while rotating along the outer circumference of the inner water tube wall 8 to create a tubular pillar of fire between the inner and outer water tube walls 8 and 6, thereby preventing a phenomenon in which the flame is concentrated in one spot to be raised to an ultra-high temperature as well as so that air lower in temperature than the flame is introduced into a combustion space S defined between the inner and outer water tube walls 8 and 6 through air injection holes formed in the inner water tube wall 8 so as to prevent the flame (F) from being excessively raised to an ultra-high temperature, thereby reducing the amount of nitrogen oxides (NOx) generated upon the burning of nitrogen in the air by the high-temperature flame. However, the Korean Registration Patent No. 10-0764903 still involves a problem in that a lot of heat of the convective gas generated in the furnace is not transferred to and absorbed by a water tube section of the furnace, but is moved upwardly to absorb the remained heat while passing through a superheater and a reheater, resulting in a great increase in the height of an upper layer of the furnace.

SUMMARY OF THE INVENTION

Accordingly, the present invention has been made in an effort to solve the aforementioned problems occurring in the prior art, and it is an object of the present invention to provide a furnace of a boiler for a power plant, in which a combustion space defined between an outer water tube section and an inner water tube section is formed in a shape closest to the natural shape of a flame so that the contact area between the water tube sections and the flame is increased to improve the temperature of water heated in the water tube sections of the furnace, thereby improving the heat absorption efficiency at the bottom of the boiler.

Another abject of the present invention is to provide a furnace of a boiler for a power plant, in which bent portions are formed at water tube sections above the flame so as to allow a convective gas having convective heat to pass therethrough so that the water tube sections of the furnace actively absorb the convective heat of the convective gas, thereby further improving the heat absorption efficiency at the bottom of the boiler.

Yet another object of the present invention is to provide a furnace of a boiler for a power plant, in which water fed to the furnace is again fed to an inner water tube section via an outer water tube section so that an inner water tube wall disposed at a low position acts as a superheater so as to decrease the height of both the entire water tubes and the boiler, thereby reducing the construction cost, and the length of the water tubes are greatly reduced so as to significantly decrease a load of a feed water pump, thereby increasing the thermal efficiency of the entire system.

Still another object of the present invention is to provide a furnace of a boiler for a power plant, in which an inner water tube wall prevents formation of a fire ball and act as a superheater so as to absorb heat generated from flames in a large amount, thereby preventing the thermal NOx formation caused by a high-temperature fire ball and preventing an ash combustion residue from being molten by the high-temperature fire ball to form slag.

A further object of the present invention is to provide a furnace of a boiler for a power plan, in which water fed to the furnace is primarily heated to be separated into hot water and steam in an outer water tube section, and only the separated steam is secondarily heated in an inner water tube section so as to produce a superheated steam more rapidly than in the case where water and steam are heated.

To accomplish the above objects, according to a first embodiment of the present invention, there is provided a furnace of a boiler for a power plant, including: an outer water tube section adapted to receive water from the outside and heat the water into hot water (including steam) while allowing the water to be moved upwardly; and an inner water tube section disposed within the outer water tube section, the inner water tube section being adapted to receive water from the outside and heat the water into hot water (including steam) while allowing the water to be moved upwardly. The outer water tube section is formed in a shape which gradually increases or is substantially uniform in diameter from the bottom thereof toward the middle portion M thereof, and gradually decreases, increase and decreases again in diameter from the middle portion M thereof toward the top thereof, and the inner water tube section is formed in a shape which gradually decreases and increases in diameter from the bottom thereof toward the middle portion M thereof, and gradually decreases, increase and decreases again in diameter from the middle portion M thereof toward the top thereof. A combustion space defined between the outer and inner water tube sections is formed in a shape which gradually increases and decreases in diameter from the bottom thereof toward the middle portion M thereof, and is formed in a serpentine shape from the middle portion thereof toward the top thereof.

To accomplish the above objects, according to a second embodiment of the present invention, there is provided a furnace of a boiler for a power plant, including: an outer water tube section adapted to allow a bottom portion thereof to receive water from the outside and heat the water into hot water (including steam) while allowing the water to be moved upwardly; an inner water tube section disposed within the outer water tube section, the inner water tube section being adapted to allow a bottom portion thereof to receive the hot water and steam from the outer water tube section and heat the hot water into steam while allowing the hot water to be moved upwardly; a downcomer tube adapted to supply hot water (including steam) moved to a top portion of the outer water tube section to the bottom portion of the inner water tube section; and a steam collecting chamber adapted to receive the heated steam moved to a top portion of the inner water tube section along the inner water tube section.

To accomplish the above objects, according to a third embodiment of the present invention, there is provided a furnace of a boiler for a power plant, including: an outer water tube section adapted to allow a bottom portion thereof to receive water from the outside and heat the water into hot water (including steam) while allowing the water to be moved upwardly; a steam and water separator adapted to receive the hot water (including steam) from the outer water tube section and separate the hot water into water and steam; an inner water tube section adapted to allow a bottom portion thereof to receive the steam separated in the steam and water separator and heat the steam into superheated steam while allowing the steam to be moved upwardly; and a steam collecting chamber adapted to receive the heated steam moved to a top portion of the inner water tube section along the inner water tube section. The water separated in the steam and water separator is again supplied to the bottom portion of the outer water tube section.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION

Figure 1:
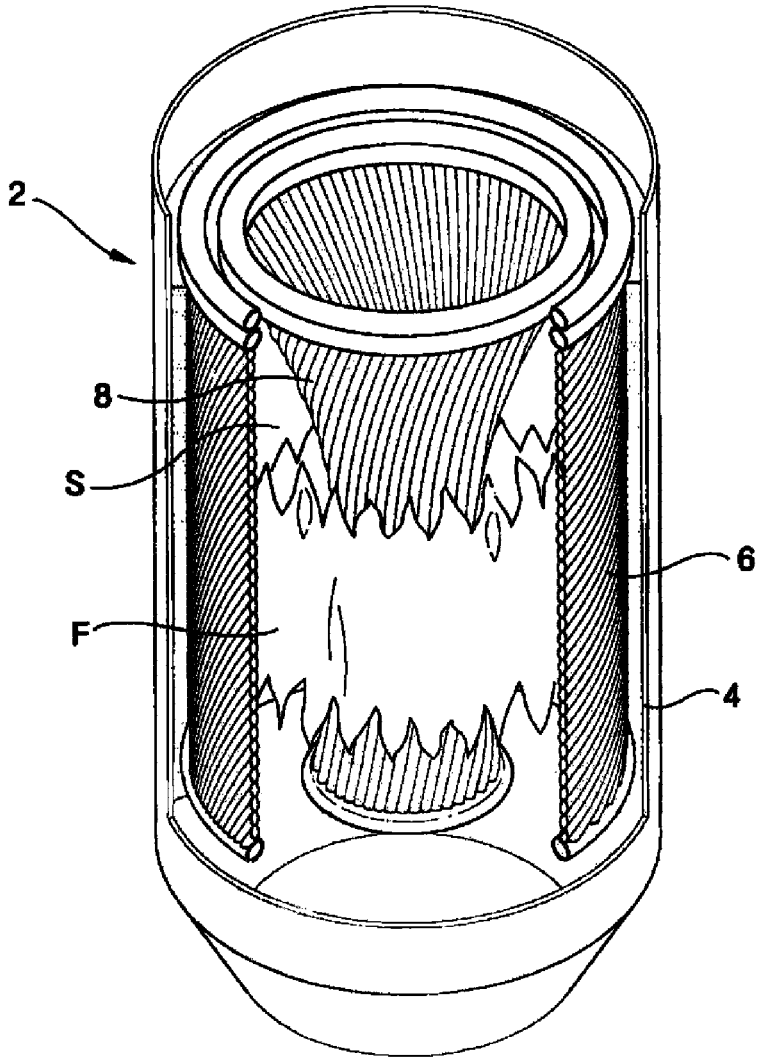
FIG. 1 Prior Art
FIG. 1 is a partially cut perspective view illustrating a conventional furnace of a boiler for a power plant according to the prior art.

Reference will now be made in detail to the preferred embodiment of the present invention, examples of which are illustrated in the drawings attached hereinafter, wherein like reference numerals refer to like elements throughout. In the following description, a variety of devices such as a steam and water separator and the like are the same as those of a conventional boiler, and thus will be omitted to avoid redundancy.

Figure 2:
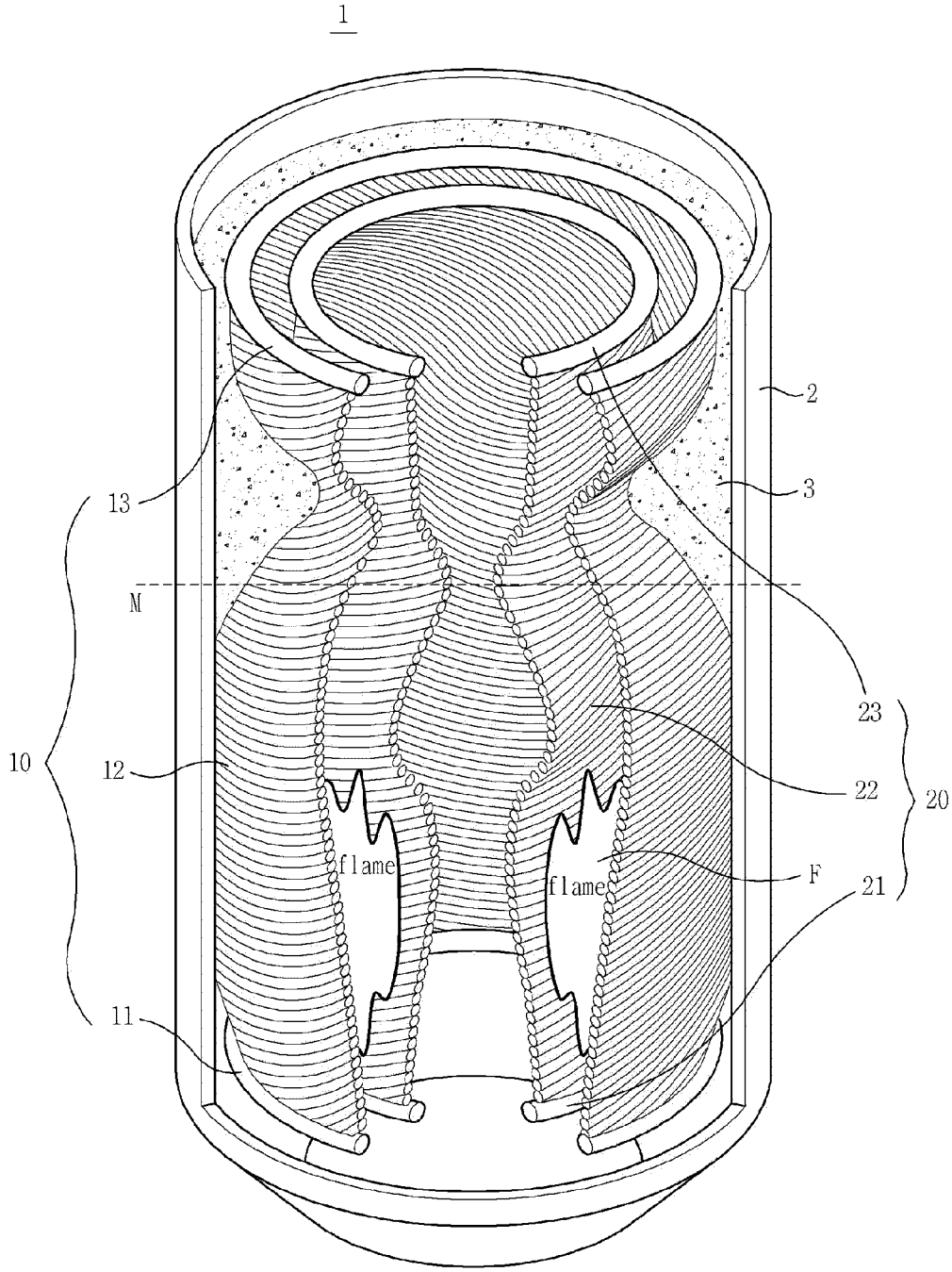
FIG. 2 is a partially cut perspective view illustrating a furnace of a boiler for a power plant according to a first embodiment of the present invention.
Figure 3:
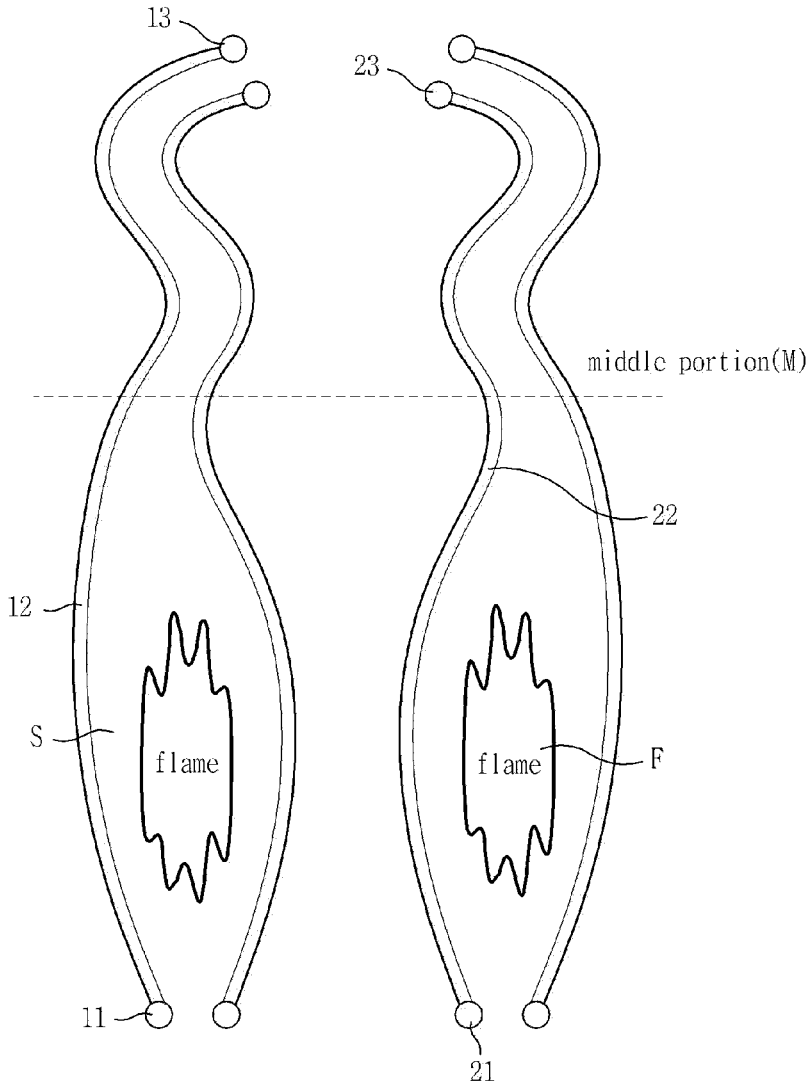
FIG. 3 is a cross-sectional view illustrating a furnace of a boiler for a power plant according to a first embodiment of the present invention.
Figure 4:
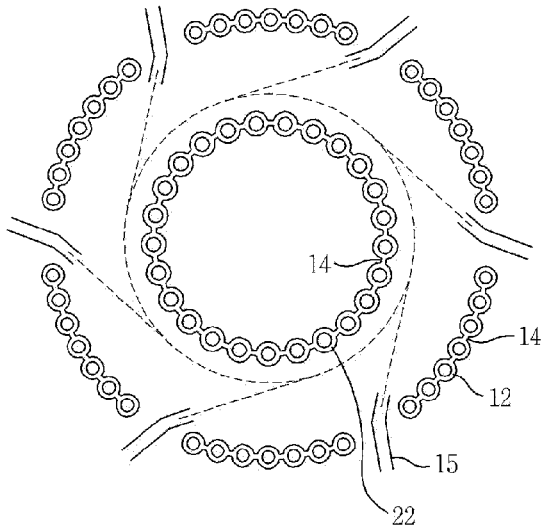
FIG. 4 is a top plan view illustrating the arrangement of the outer and inner water tube sections installed in a combustion chamber of a boiler for a power plant according to a first embodiment of the present invention.
Figure 5:
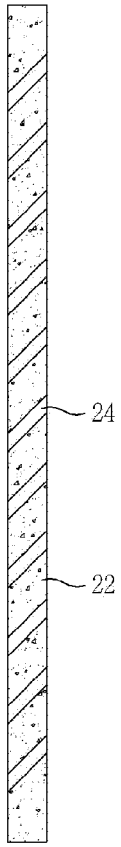
FIG. 5 is a vertical cross-sectional view illustrating air injection holes formed in an inner water tube section installed in a combustion chamber of a boiler for a power plant according to a first embodiment of the present invention.

FIG. 2 is a partially cut perspective view illustrating a furnace of a boiler for a power plant according to a first embodiment of the present invention, FIG. 3 is a cross-sectional view illustrating a furnace of a boiler for a power plant according to a first embodiment of the present invention, FIG. 4 is a top plan view illustrating the arrangement of the outer and inner water tube sections installed in a combustion chamber of a boiler for a power plant according to a first embodiment of the present invention, and FIG. 5 is a vertical cross-sectional view illustrating air injection holes formed in an inner water tube section installed in a combustion chamber of a boiler for a power plant according to a first embodiment of the present invention.

As shown in FIGS. 2 to 5, a furnace 1 of a boiler for a power plant according to a first embodiment of the present invention includes an outer water tube section 10 disposed at the inner circumference thereof and consisting of a plurality of water tubes connectingly extending along a furnace wall 2 thereof, and an inner water tube section 20 disposed within the outer water tube section 10 and consisting of a plurality of water tubes connectingly extending.

The outer water tube section 10 includes a first lower header 11 disposed at a lower portion thereof and adapted to receive water from the outside, an outer water tube wall 12 adapted to receive the water introduced into the first lower header 11 from the first lower header 11 and heat the introduced water into hot water (including steam) while allowing the water to be moved upwardly along a plurality of water tubes, and a first upper header 13 disposed at an upper portion thereof and adapted to collect the hot water (including steam) moved upwardly along the outer water tube wall 12.

The inner water tube section 20 includes a second lower header 21 disposed at a lower portion thereof and adapted to receive water from the outside, an inner water tube wall 22 adapted to receive the water introduced into the second lower header 21 from the second lower header 21 and heat the introduced water into hot water (including steam) while allowing the water to be moved upwardly along a plurality of water tubes, and a second upper header 23 disposed at an upper portion thereof and adapted to collect the hot water (including steam) moved upwardly along the inner water tube wall 12.

A space define between the outer furnace wall and the outer water tube section 10 is filled with a heat insulating material 3, and each of the outer water tube wall 12 and the inner water tube wall 22 is constructed such that a strip-shaped connecting lamella, i.e., a membrane 14 is disposed between two adjacent water tubes, respectively, in such a fashion that a plurality of membranes is circumferentially arranged in parallel with one another, so that the membranes and the respective water tubes are jointly connected with each other by parallel welding so as to form a circular wall to thereby support the outer water tube wall 12 and the inner water tube wall 22.

Also, the first upper header 13 and the second upper header 23 are connected to a superheater (not shown) mounted on the top of the furnace 1.

Meanwhile, the outer water tube wall 12 is formed in a shape which gradually increases or is substantially uniform in diameter from the bottom thereof toward the middle portion M thereof, and gradually decreases, increase and decreases again in diameter from the middle portion M toward the top thereof. Also, the inner water tube wall 22 is disposed within the outer water tube wall 12. The inner water tube wall 22 is formed in a shape which gradually decreases and increases in diameter from the bottom thereof toward the middle portion M thereof, and gradually decreases, increase and decreases again in diameter from the middle portion M toward the top thereof relative to the outer water tube wall 12. In this case, the shapes of the outer and inner water tube walls 10 and 20 from the middle portion M to the top thereof may be repeated in a zigzag pattern.

Thus, a combustion space S defined between the outer and inner water tube sections 10 and 20 is formed in a shape which gradually increases and decreases in diameter from the bottom thereof toward the middle portion M thereof, and is formed in a serpentine shape which is substantially uniform in width from the middle portion M thereof toward the top thereof. That is, a lower portion of the combustion space S bulges outwardly at the center thereof like an earthenware jar, and an upper portion of the combustion space S is formed in a serpentine shape which is uniform in width while being smaller in width than the lower portion of the combustion space 5, so that a candle-shaped flame generated between the outer and inner water tube walls escapes upwardly. In this case, the radiation heat of the flame emitted in all directions heats a large surface area surrounded by the top and the bottom of the furnace, and the convective heat of the flame comes into close contact with more water tubes while passing through the middle portion and the serpentine portion of the combustion space S, thereby increasing the heat transfer effect of the flame.

In addition, the outer water tube wall 12 includes a plurality of fuel injection nozzles 15 formed thereon in such a fashion as to be arranged spaced apart from one another at regular intervals along a circumferential direction and a lengthwise direction. The fuel injected from the fuel injection nozzles 15 is injected into the combustion space S defined between the outer and inner water tube walls 12 and 22 to form a large curved tubular flame F so as to heat the water flowing in the outer and inner water tube walls 12 and 22. The outer surfaces of the outer and inner water tube walls 12 and 22 are preferably subjected to a corrosion-resistant coating and a high temperature and corrosion resistant coating so as to prevent high-temperature corrosion and thermal damage.

As shown in FIG. 5, the inner water tube wall 22 includes a plurality of air injection holes 24 formed in a membrane thereof. The air injection holes 24 serves to drop the temperature of the flame F generated upon the burning of the fuel injected into the combustion space between the inner water tube wall 22 and the outer water tube wall 12 with air supplied form an air pump connected with the inner space of the inner water tube wall 22 so as to prevent the water from being heated to an ultra-high temperature.

The operation of the furnace of a boiler for a power plant according to a first embodiment of the present invention as constructed above will be described hereinafter in detail.

First, after all the water tubes are filled with water and the interior of the furnace 1 is heated by erupting the flame with an oil burner, when the fuel is injected into the flame of the oil burner with air through the plurality of fuel injection nozzles 14 mounted on the outer water tube wall 12 or a pulverized (or powdered) coal from the bottom of the furnace is injected into the flame of the oil burner, the pulverized coal is ignited in a state where the furnace 1 is heated by the flame of the oil burner. Then, when the pulverized coal starts to be burnt, a user extinguishes the oil burner.

The outer water tube section 10 and the inner water tube section 20 allow the first lower header 11 and the second lower header 21 to receive water from the outside, heat the water into hot water (including steam) while allowing the water to be moved upwardly along the outer water tube wall 12 and the inner water tube wall 22. Then, the hot water and steam are supplied to and collected in the first upper header 13 and the second upper header 23.

When a pulverized coal flame F grows and is shaken furiously, the air is injected into the combustion space S between the inner water tube wall 22 and the outer water tube wall 12 through the air injection holes 24 of the inner water tube wall 22.

In the meantime, the fuel injection nozzles 15 mounted on the outer water tube wall 12 are oriented in a tangential direction with respect to the inner water tube wall 22 so that the flame F generated upon the burning of the fuel injected from the fuel injection nozzles 15 is captured in the combustion space S in such a fashion as to collide against and to be reflected from the inner water tube section 20, and then to again collide against the outer water tube section to thereby create a tubular pillar of fire.

Thus, since the flame F rotates in a tangential direction of the inner water tube wall 22 in the combustion space S between the outer and inner water tube walls 10 and 20, a phenomenon does not occur in which the flame generated upon the burning of the fuel injected from the fuel injection nozzles 15 is concentrated in one spot. Therefore, the temperature of the flame F is not raised to the temperature at which nitrogen is oxidized as well as cool air is injected from the outside through the air injection holes 24 of the inner water tube wall 22, if necessary, so that the temperature of the flame F is lowered. Therefore, the flame F generated upon the burning of the fuel injected from the fuel injection nozzles 15 in the combustion space S is not boosted to an ultra-high temperature of 1300° C.

In the meantime, the combustion space S defined between the outer and inner water tube walls 10 and 20 is formed in a shape which gradually increases and decreases in diameter from the bottom thereof toward the middle portion M thereof, and is formed in a serpentine shape which is substantially uniform in width from the middle portion thereof toward the top thereof. Accordingly, a space having a natural flame shape surrounded in all directions of the furnace maximally absorbs the radiation heat of the flame, and the convective gas having the convective heat of the flame comes into close contact with more water tubes while passing through the middle portion and the serpentine portion of the combustion space S, thereby increasing heat absorption efficiency.

Therefore, the furnace for a power plant according to a first embodiment of the present invention the combustion space S defined between the outer and inner water tube walls 10 and 20 is formed in a shape closest to the natural shape of a flame so that the heat transfer area is maximized and the distance between the flame and the outer and inner water tube walls is reduced, thereby improving the heat transfer effect as well as so that since the flame loses heat by the water tubes to cause the temperature of the flame to drop, nitrogen within and around the flame is not oxidized, thereby preventing formation of the nitrogen oxides (NOx).

Figure 6:
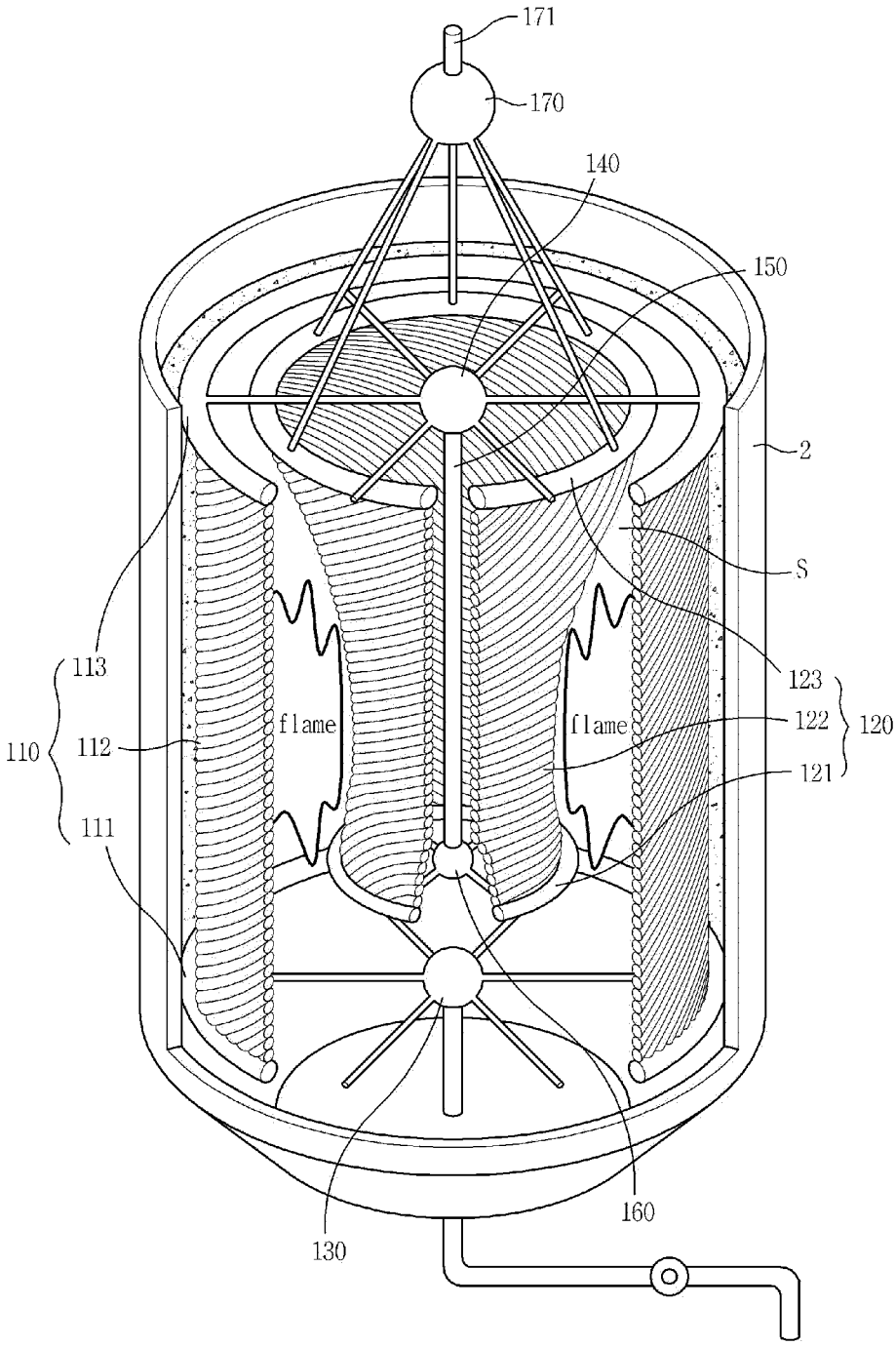
FIG. 6 is a partially cut perspective view illustrating a furnace of a boiler for a power plant according to a second embodiment of the present invention.
Figure 7:
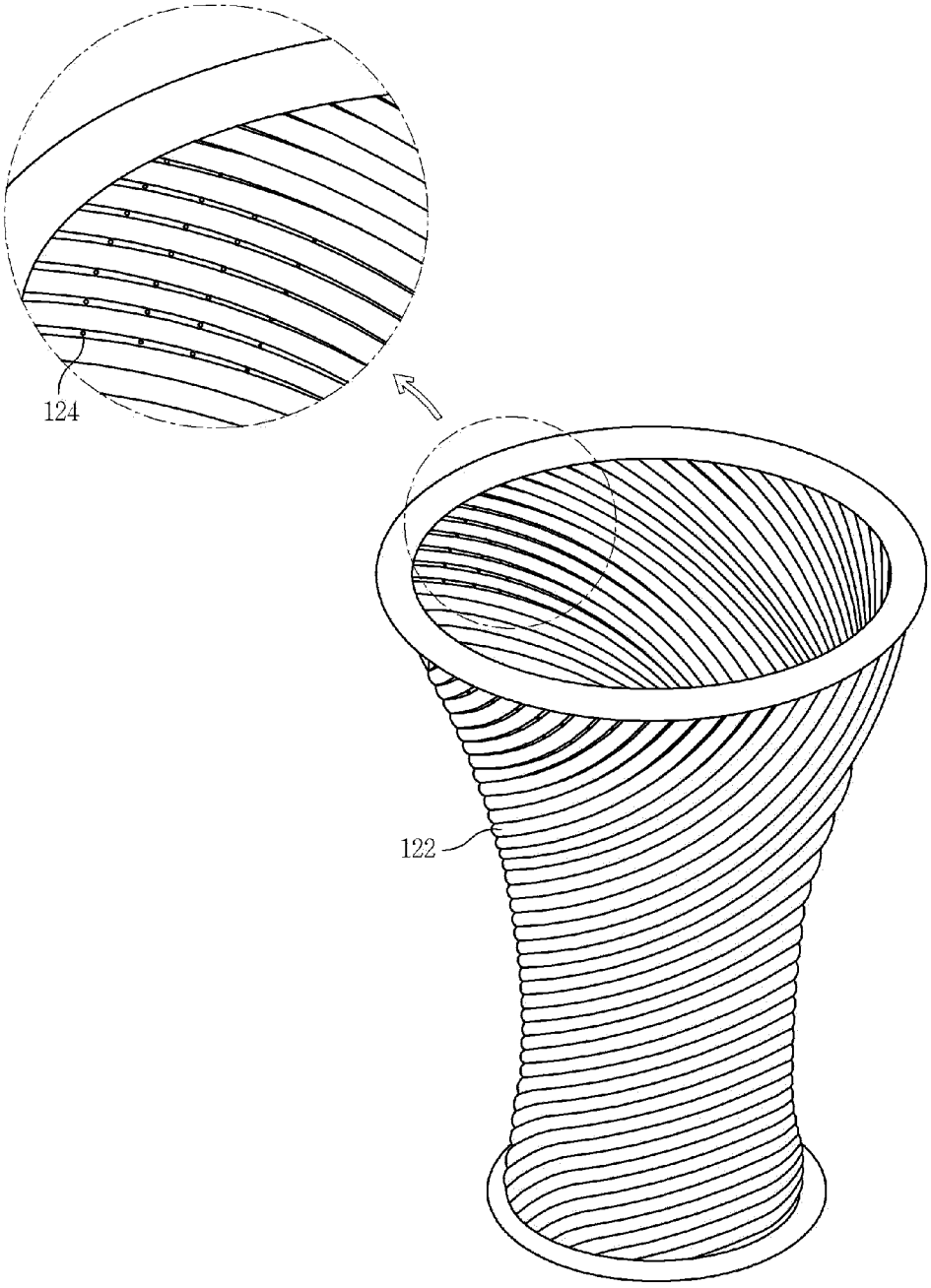
FIG. 7 is a top perspective view illustrating an inner water tube wall installed in a combustion chamber of a boiler for a power plant according to a second embodiment of the present invention.

FIG. 6 is a partially cut perspective view illustrating a furnace of a boiler for a power plant according to a second embodiment of the present invention, and FIG. 7 is a top perspective view illustrating an inner water tube wall installed in a combustion chamber of a boiler for a power plant according to a second embodiment of the present invention.

As shown in FIGS. 6 and 7, a furnace 1 of a pulverized coal-fired boiler for a power plant includes an outer water tube section 110 disposed at the inner circumference thereof and consisting of a plurality of water tubes connectingly extending along a furnace wall 2 thereof, and an inner water tube section 120 disposed within the outer water tube section 110 and consisting of a plurality of water tubes connectingly extending. Also, the furnace 1 of a pulverized coal-fired boiler further includes a downcomer tube 150 adapted to supply hot water (including steam) moved to a top portion of the outer water tube section 110 to a bottom portion of the inner water tube section 120, and a steam collecting chamber 170 adapted to receive the heated steam moved to a top portion of the inner water tube section along the inner water tube section. In addition, the furnace 1 of a pulverized coal-fired boiler further includes a first lower water collecting chamber 130 adapted to receive water from the outside and supply the received water to the outer water tube section 110, an upper water collecting chamber 140 adapted to collect the hot water (including the steam) moved to the top portion of the outer water tube section 110 and supply the collected hot water and steam to the downcomer tube 150, and a second water collecting chamber 160 adapted to collect the hot water and steam fed downwardly along the downcomer tube 150 and supply the collected hot water and steam to the bottom portion of the inner water tube section 120. The downcomer tube 150 disposed within the inner water tube section 120.

The outer water tube section 110 includes a first lower header 110 disposed at a lower portion thereof and adapted to receive water from the first lower water collecting chamber 130 through a plurality of water tubes, an outer water tube wall 112 adapted to receive the water introduced into the first lower header 111 from the first lower header 111 and heat the introduced water into hot water (including steam) while allowing the water to be moved upwardly along a plurality of water tubes, and a first upper header 113 disposed at an upper portion thereof, the first upper header being adapted to collect the hot water (including steam) moved upwardly along the outer water tube wall 112 and supply the collected hot water and steam to the upper water collecting chamber 140 through a plurality of water tubes.

The inner water tube section 120 includes a second lower header 121 disposed at a lower portion thereof and adapted to receive the hot water (including steam) from the second water collecting chamber 160 through a plurality of water tubes, an inner water tube wall 122 adapted to receive the hot water (including steam) introduced into the second lower header 121 from the second lower header 121 and heat the introduced hot water into steam while allowing the water to be moved upwardly along a plurality of water tubes, and a second upper header 123 disposed at an upper portion thereof, the second upper header being adapted to collect the heated steam moved upwardly along the inner water tube wall 112 and supply the collected steam to the steam collecting chamber 170 through a plurality of water tubes. In addition, mounted to the steam collecting chamber 170 is a steam supply tube 171 for supplying the steam collected in the steam collecting chamber 170 to a turbine. In this case, the steam supply tube 171 may be constructed such that it extends curvedly while circulating and passing through a flame discharge path so as to further absorb the heat to thereby produce a high-temperature, high-pressure steam, if necessary.

In the meantime, the outer water tube wall 112 is formed in a shape whose upper and lower portions are substantially the same as each other in diameter, and the inner water tube wall 122 is formed in a shape which gradually increase in diameter from the bottom thereof toward the top thereof. Thus, the combustion space S defined between the outer and inner water tube sections 112 and 122 is formed in a shape whose width is larger at a lower portion thereof and is smaller at an upper portion thereof, so that the fuel is sufficiently burnt at the lower portion of the combustion space S within the furnace, and the radiation heat of the flame generated upon the burning of the fuel is transferred to the outer and inner water tube walls as well as the inner water tubes positioned directly above the flame in the furnace, so that the radiation heat absorbing area of the combustion space positioned below a superheater increases and simultaneously the convective gas having the convective heat of the flame generated upon the burning of the fuel comes into close contact with more water tubes while passing through the upper portion of the combustion space, thereby enhancing the thermal efficiency.

Further, as in the first embodiment of the present invention, the outer water tube wall 112 includes a plurality of fuel injection nozzles 15 formed thereon in such a fashion as to be arranged spaced apart from one another at regular intervals along a circumferential direction and a lengthwise direction. The inner water tube wall 122 includes a plurality of air injection holes 124 formed therein.

The operation of the furnace of a boiler for a power plant according to a second embodiment of the present invention as constructed above will be described hereinafter in detail.

First, the interior of the furnace 1 is heated by erupting the flame with an oil burner in a state where water is fed to the first lower water collecting chamber 130 to preheat the furnace. Thereafter, a pulverized (or powdered) coal is injected into the flame of the oil burner so as to be ignited or maintained in the ignition state, or the pulverized coal is directly injected into the flame the without preheating so as to be ignited with a plasma burner and maintained in the ignition state to thereby heat the outer and inner water tube walls.

The water fed to the first lower water collecting chamber 130 is supplied to the first lower header 111 of the outer water tube section, and is heated into hot water (including steam) while being moved along the outer water tube wall 112. Then, the hot water (including steam) is fed to the upper water collecting chamber 140 via the first upper header 113.

The hot water (including steam) fed to the upper water collecting chamber 140 is supplied to the second water collecting chamber 160 along the downcomer tube 150 disposed within the inner water tube section. The hot water (including steam) supplied to the second water collecting chamber 160 is fed to the second lower header 121 of the inner water tube section, and is heated into superheated steam having a supercritical pressure while being moved upwardly along the inner water tube wall 122. Then, the superheated steam is supplied to the steam collecting chamber 170 via the second upper header 123. Thus, the steam passing through the inner water tube section 120 can be easily heated into the superheated steam having a supercritical pressure since the water and steam introduced into the inner water tube section is already maintained in a high-temperature state.

Subsequently, the superheated steam of the supercritical pressure collected in the steam collecting chamber 170 is transferred to the turbine through the steam supply tube 171, thereby improving the operation efficiency of the turbine. Moreover, the inner water tube section serves as a superheater for producing the superheated steam as well as can eliminate the necessity of the superheater and greatly reduce the size of the superheater so that the height of the entire boiler can be reduced to thereby save the construction cost, and the length of the upper water tubes can be greatly reduced so as to significantly decrease a load of the feed water pump, thereby increasing the thermal efficiency of the entire system.

According to the second embodiment of the present invention, since the hot water supplied from the outer water tube wall is heated while circulating through the inner water tube section without being fed to the turbine, when high-temperature water fed to the inner water tube section passes through the inner water tube wall, it is converted into the superheated steam having the supercritical pressure and is transferred to the turbine, thereby improving the operation efficiency of the turbine.

Figure 8:
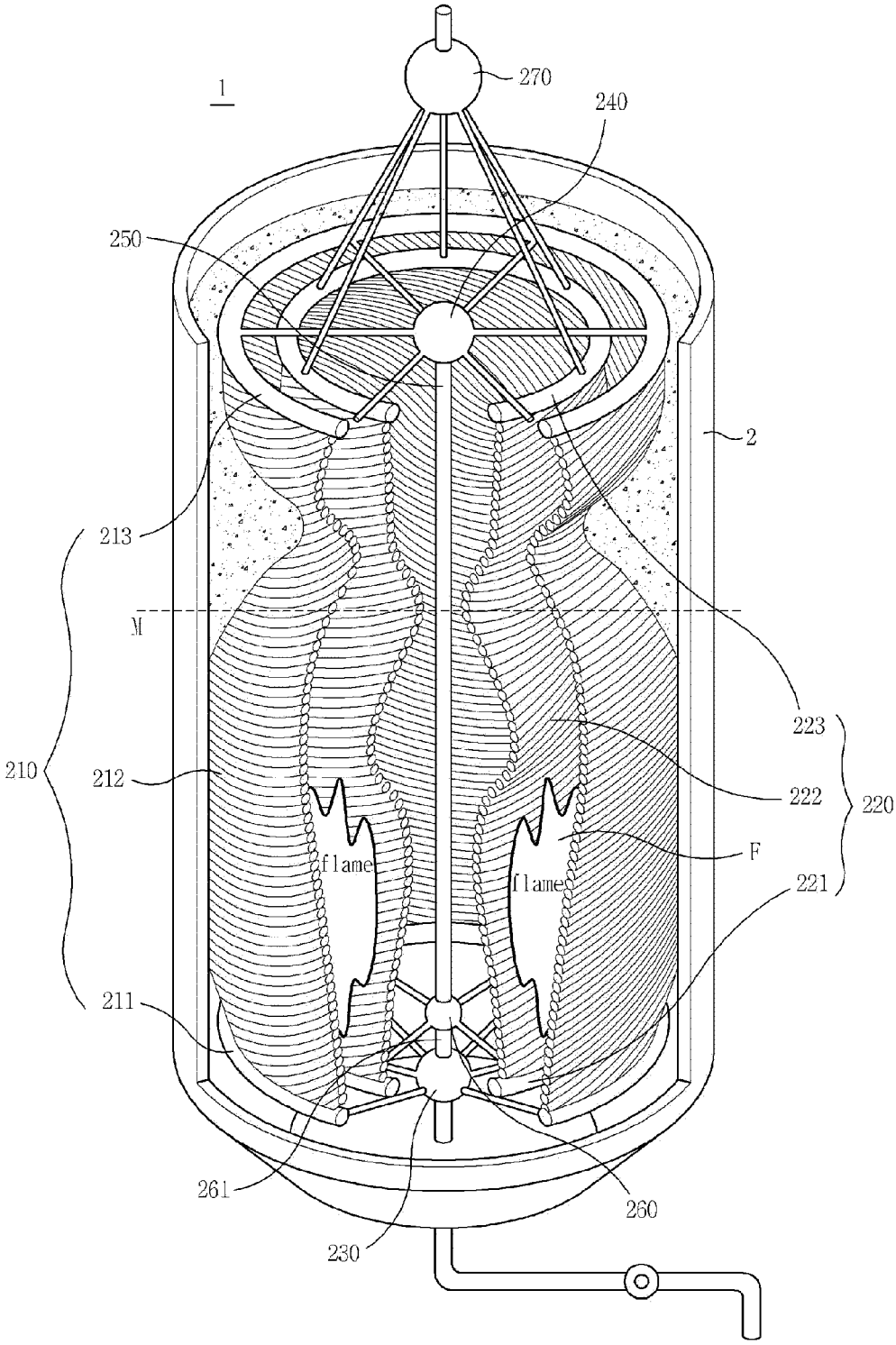
FIG. 8 is a partially cut perspective view illustrating a furnace of a boiler for a power plant according to a third embodiment of the present invention.

FIG. 8 is a partially cut perspective view illustrating a furnace of a boiler for a power plant according to a third embodiment of the present invention.

As shown in FIG. 8, a furnace 1 of a pulverized coal-fired boiler for a power plant includes: an outer water tube section 210 disposed at the inner circumference thereof and consisting of a plurality of water tubes connectingly extending along a furnace wall 2 thereof, the outer water tube section being adapted to allow a bottom portion thereof to receive water from the outside and heat the water into hot water (including steam) while allowing the water to be moved upwardly; a steam and water separator 260 adapted to receive the hot water (including steam) from the outer water tube section 210 and separate the hot water into water and steam; an inner water tube section 220 adapted to allow a bottom portion thereof to receive the steam separated in the steam and water separator 260 from the outside and heat the steam into superheated steam while allowing the steam to be moved upwardly; and a steam collecting chamber 270 adapted to receive the heated steam moved to a top portion of the inner water tube section along the inner water tube section 220.

Also, the furnace 1 of a pulverized coal-fired boiler further includes a lower water collecting chamber 230 adapted to receive water from the outside and supply the received water to the outer water tube section 210, an upper water collecting chamber 240 adapted to collect the hot water (including the steam) moved to the top portion of the outer water tube section 210 and supply the collected hot water and steam to steam and water separator 260. In this case, the steam and water separator 260 is disposed within the inner water tube section 220, and the water separated in the steam and water separator 260 is again supplied to the bottom portion of the outer water tube section 210.

In the same manner as in the first and second embodiments, the outer water tube section 210 includes a first lower header 210 disposed at a lower portion thereof and adapted to receive water from the lower water collecting chamber 230 through a plurality of water tubes, an outer water tube wall 212 adapted to receive the water introduced into the first lower header 211 from the first lower header 211 and heat the introduced water into hot water (including steam) while allowing the water to be moved upwardly along a plurality of water tubes, and a first upper header 213 disposed at an upper portion thereof, the first upper header being adapted to collect the hot water (including steam) moved upwardly along the outer water tube wall 212 and supply the collected hot water and steam to the upper water collecting, chamber 240 through a plurality of water tubes.

The inner water tube section 120 includes a second lower header 221 disposed at a lower portion thereof and adapted to receive the steam from the steam and water separator 260 through a plurality of water tubes, an inner water tube wall 222 adapted to receive the steam introduced into the second lower header 221 from the second lower header 221 and heat the introduced steam into superheated steam while allowing the steam to be moved upwardly along a plurality of water tubes, and a second upper header 223 disposed at an upper portion thereof, the second upper header being adapted to collect the heated steam moved upwardly along the inner water tube wall 222 and supply the collected steam to the steam collecting chamber 270 through a plurality of water tubes. In addition, mounted to the steam collecting chamber 270 is a steam supply tube 271 for supplying the steam collected in the steam collecting chamber 270 to a turbine.

In this case, the outer water tube wall 212 is formed in a shape which gradually increases or is substantially uniform in diameter from the bottom thereof toward the middle portion M thereof, and gradually decreases, increase and decreases again in diameter from the middle portion M toward the top thereof. Also, the inner water tube wall 222 is disposed within the outer water tube wall 112. The inner water tube wall 222 is formed in a shape which gradually decreases and increases in diameter from the bottom thereof toward the middle portion M thereof, and gradually decreases, increase and decreases again in diameter from the middle portion M toward the top thereof relative to the outer water tube wall 212.

Thus, a combustion space S defined between the outer and inner water tube sections 212 and 222 is formed in a shape which gradually increases and decreases in diameter from the bottom thereof toward the middle portion M thereof, and is formed in a serpentine shape which is substantially uniform in width from the middle portion M thereof toward the top thereof. That is, a lower portion of the combustion space S bulges outwardly at the center thereof like an earthenware jar, and an upper portion of the combustion space S is formed in a serpentine shape which is uniform in width while being smaller in width than the lower portion of the combustion space S, so that a candle-shaped flame generated between the outer and inner water tube walls escapes upwardly. In this case, the radiation heat of the flame emitted in all directions heats a large surface area surrounded by the top and the bottom of the furnace, and the convective heat of the flame comes into close contact with more water tubes while passing through the middle portion and the serpentine portion of the combustion space S, thereby increasing the heat transfer effect of the flame.

The steam and water separator 260 is disposed between the upper water collecting chamber 240 and the second lower header 221, and receives the hot water (including steam) from the upper water collecting chamber 240 through the downcomer tube 250 and separate the hot water into water and steam. The separated steam is supplied to the second lower header 221 through a plurality of water tubes, and the separated heated water is again supplied to the lower water collecting chamber 230 through an auxiliary water tube 216. Also, the steam and water separator 260 is disposed between the first upper header 213 and the upper water collecting chamber 240, and receives the heated water from the first upper header 213 and separate the water into water and steam. The separated steam may be supplied to the upper water collecting chamber 240, and the separated water may be supplied to the lower water collecting chamber 230. Since only the steam is heated while being moved along the inner water tube wall 222 by the steam and water separator, the heating effect is enhanced so that the steam having passed through the inner water tube wall is changed into superheated steam having a supercritical pressure and the superheated steam is supplied to the turbine, thereby increasing the operation efficiency of the turbine.

In addition, as in the first and second embodiments, the outer water tube wall 212 includes a plurality of fuel injection nozzles 15 formed thereon in such a fashion as to be arranged spaced apart from one another at regular intervals along a circumferential direction and a lengthwise direction. The inner water tube wall 222 includes a plurality of air injection holes 24 formed therein. The outer surfaces of the outer and inner water tube walls 212 and 222 are preferably subjected to a corrosion-resistant coating and a high temperature and corrosion resistant coating so as to prevent high-temperature corrosion and thermal damage.

The operation of the furnace of a boiler for a power plant according to a third embodiment of the present invention as constructed above will be described hereinafter in detail.

First, the interior of the furnace 1 is heated by erupting the flame with an oil burner in a state where water is fed to the first lower water collecting chamber 130 to preheat the furnace. Thereafter, a pulverized (or powdered) coal is injected into the flame of the oil burner so as to be ignited or maintained in the ignition state, or the pulverized coal is directly injected into the flame the without preheating so as to be ignited with a plasma burner and maintained in the ignition state to thereby heat the outer and inner water tube walls 210 and 220.

The water fed to the lower water collecting chamber 230 is supplied to the first lower header 211 of the outer water tube section through a plurality of water tubes, and then is heated into hot water (including steam) while being moved upwardly along the outer water tube wall 212 so that the hot water (including steam) is supplied to the upper water collecting chamber 240 via the first upper header 213.

Thereafter, when the hot water (including steam) supplied to the upper water collecting chamber 240 is fed to the steam and water separator 260 through the downcomer tube 250, the steam and water separator 260 separates the hot water into heated water and steam so that the separated water is again supplied to the lower water collecting chamber 230 and is re-heated while being moved along the outer water tube section 210.

Meanwhile, the steam separated in the steam and water separator 260 is supplied to the second lower header 221 disposed at a lower portion of the inner water tube section 220, and is heated while being moved upwardly along the inner water tube wall 222 so as to be fed to the second upper header 223. Thus, the steam passing through the inner water tube section is supplied to the steam collecting chamber 270 in the state of superheated steam having a supercritical pressure, and then is supplied to the turbine, thereby increasing the operation efficiency of the turbine.

It will be easily understood by a person skilled in the art that the present invention can be applied to the pulverized coal-fired boiler as well as other types of boilers.

As described above, the furnace of a boiler for a power plant according to a first embodiment of the present invention has advantageous effects in that since a combustion space defined between an outer water tube section and an inner water tube section where a flame is formed is formed in a shape closest to the natural shape of a flame, the contact area between the water tube sections and the flame is increased and the distance between the flame and the water tube walls is reduced to improve the temperature of water heated in the water tube sections of the furnace, thereby improving the heat absorption efficiency of the boiler, and in that the flame is formed in the shape of a tubular pillar of fire, but not a high-temperature fire ball so that the temperature of the flame is lowered by emission of the radiation and convective heat on in a large area, thereby preventing the thermal NOx formation caused by a high-temperature fire ball and preventing an ash combustion residue from being molten by the high-temperature fire ball to form slag.

Also, the furnace of a boiler for a power plant according to a second embodiment of the present invention has advantageous effects in that since water fed to the furnace is again fed to an inner water tube section via an outer water tube section, an inner water tube wall acts as a superheater to replace a superheater typically disposed at the top portion of the furnace or reduce the size of the superheater so that the height of both the upper water tubes and the boiler and the length of the water tubes are greatly reduced so as to significantly decrease a load of a feed water pump, thereby increasing the thermal efficiency of the entire system.

In addition, the furnace of a boiler for a power plant according to a third embodiment of the present invention has advantageous effects in that water fed to the furnace is primarily heated to be separated into hot water and steam in an outer water tube section, and only the separated steam is secondarily heated in an inner water tube section so as to produce a superheated steam having a supercritical pressure.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A furnace of a boiler for a power plant, comprising:

an outer water tube section adapted to allow a bottom portion thereof to receive water from the outside and heat the water into hot water and steam while allowing the water to be moved upwardly;

an inner water tube section disposed within the outer water tube section, the inner water tube section being adapted to allow a bottom portion thereof to receive the hot water and steam from the outer water tube section and heat the hot water into steam while allowing the hot water to be moved upwardly;

a downcomer tube adapted to supply hot water and steam moved to a top portion of the outer water tube section to the bottom portion of the inner water tube section;

a steam collecting chamber adapted to receive the heated steam moved to a top portion of the inner water tube section along the inner water tube section;

a first lower water collecting chamber adapted to receive water from the outside and supply the received water to the outer water tube section;

an upper water collecting chamber adapted to collect the hot water and steam moved to the top portion of the outer water tube section and supply the collected hot water and steam to the downcomer tube;

a second water collecting chamber adapted to collect the hot water and steam fed downwardly along the downcomer tube and supply the collected hot water and steam to the bottom portion of the inner water tube section, wherein the outer water tube section comprises a first lower header disposed at a lower portion thereof and adapted to receive water from the first water collecting chamber;

an outer water tube wall adapted to receive the water introduced into the first lower header from the first lower header and heat the introduced water into hot water and steam while allowing the water to be moved upwardly along a plurality of water tubes;

a first upper header disposed at an upper portion thereof, the first upper header being adapted to collect the hot water and steam moved upwardly along the outer water tube wall and supply the collected hot water and steam to the upper water collecting chamber, wherein the inner water tube section comprises a second lower header disposed at a lower portion thereof and adapted to receive the hot water and steam from the second water collecting chamber;

an inner water tube wall adapted to receive the hot water and steam introduced into the second lower header from the second lower header and heat the introduced hot water into steam while allowing the water to be moved upwardly along a plurality of water tubes, and a second upper header disposed at an upper portion thereof, the second upper header being adapted to collect the heated steam moved upwardly along the inner water tube wall and supply the collected steam to the steam collecting chamber, wherein a membrane is disposed between two adjacent water tubes of each of the inner water tube wall and the outer water tube wall, such that a plurality of membranes are circumferentially arranged in parallel with one another, so that the membranes and the respective water tubes are jointly connected with each other by parallel welding so as to form a circular wall, such that a fire ball or flame is prevented from forming inside the inner water tube wall and forming between the inner water tube wall and the outer water tube wall, wherein the downcomer tube is disposed within the inner water tube section through a central space surrounded by the inner water tube wall, wherein the upper water collecting chamber and the second water collecting chamber are connected by the downcomer tube, wherein each of the steam collecting chamber, a first lower water collecting chamber, the upper water collecting chamber, and the second water collecting chamber is disposed vertically along a direction of the downcomer tube.

2. The furnace of a boiler for a power plant according to claim 1, wherein the outer water tube wall is formed in a shape whose upper and lower portions are substantially the same as each other in cross-section, and the inner water tube wall is formed in a shape which gradually increase in diameter from the bottom thereof toward the top thereof.

3. The furnace of a boiler for a power plant according to claim 1, wherein the outer water tube wall is formed in a shape which gradually increases or is substantially uniform in diameter from the bottom thereof toward the middle portion M thereof, and gradually decreases, increase and decreases again in diameter from the middle portion M thereof toward the top thereof and the inner water tube wall is formed in a shape which gradually decreases and increases in diameter from the bottom thereof toward the middle portion M thereof and gradually decreases, increase and decreases again in diameter from the middle portion M thereof toward the top thereof and wherein a combustion space defined between the outer and inner water tube sections is formed in a shape which gradually increases and decreases in diameter from the bottom thereof toward the middle portion M thereof and is formed in a serpentine shape from the middle portion thereof toward the top thereof.

4. The furnace of a boiler for a power plant according to claim 1 wherein the outer water tube wall includes a plurality of fuel injection nozzles formed thereon in such a fashion as to be arranged spaced apart from one another at regular intervals along a circumferential direction and a lengthwise direction, the inner water tube wall includes a plurality of air injection holes formed therein.

5. The search system according to claim 1, wherein the outer surfaces of the outer and inner water tube walls are subjected to a corrosion-resistant coating and a high temperature and corrosion resistant coating.

* * * * *